US009795176B2

(12) United States Patent
Hazzard

(10) Patent No.: US 9,795,176 B2
(45) Date of Patent: Oct. 24, 2017

(54) BREAST SUPPORT GARMENT

(71) Applicant: Charlotte Hazzard, Phoenix, AZ (US)

(72) Inventor: Charlotte Hazzard, Phoenix, AZ (US)

( * ) Notice: Subject to any disclaimer, the term of this patent is extended or adjusted under 35 U.S.C. 154(b) by 0 days.

(21) Appl. No.: 15/229,332

(22) Filed: Aug. 5, 2016

(65) Prior Publication Data

US 2017/0035130 A1 Feb. 9, 2017

Related U.S. Application Data

(60) Provisional application No. 62/201,198, filed on Aug. 5, 2015.

(51) Int. Cl.
*A41C 3/00* (2006.01)
*A41F 15/00* (2006.01)

(52) U.S. Cl.
CPC ..... *A41F 15/002* (2013.01); *A41C 3/0028* (2013.01)

(58) Field of Classification Search
CPC ..... A41C 3/00; A41C 3/0014; A41C 3/0035; A41C 3/0021; A41C 3/02; A41C 3/005; A41C 3/0028; A41C 3/0057
USPC ..... 450/86, 62–64, 79, 85
See application file for complete search history.

(56) References Cited

U.S. PATENT DOCUMENTS 1,926,078 A * 9/1933 Yonts ..... A41F 1/006 450/86
2,671,217 A * 3/1954 Studler ..... A41C 3/00 2/338
2,849,723 A * 9/1958 Marino ..... A41F 15/005 2/323
3,008,468 A * 11/1961 Williams ..... A41C 3/00 450/2
3,027,898 A * 4/1962 Williams ..... A41F 15/00 450/86
3,185,157 A * 5/1965 Gingras ..... A41C 3/00 450/59
3,186,412 A * 6/1965 Kurland ..... A41C 3/00 2/323
3,215,144 A * 11/1965 Schustack ..... A41F 1/006 2/325
3,220,415 A * 11/1965 Marino ..... A41C 3/00 450/65
3,227,185 A * 1/1966 Locascio ..... A41C 3/00 2/338
3,982,547 A * 9/1976 Walker ..... A41C 3/00 2/300
5,221,227 A 6/1993 Michels
(Continued)

*Primary Examiner* — Gloria Hale
(74) *Attorney, Agent, or Firm* — Global Intellectual Property Agency, LLC; Daniel Enea

(57) ABSTRACT

A breast support garment. The breast support garment includes a first breast cup connected to a second breast cup, a connecting band having a first end connected to the first breast cup and a second end connected to the second breast cup. A first strap is connected to the first breast cup at one end and to the connecting band at a second end, and a second strap is connected to the second breast cup at one end and to the connecting band at a second end. The first and second straps extend from the first and second breast cups in a direction opposing one another and are each secured thereto at an obtuse angle with respect to the connecting band. When worn by an individual, the first and second straps are positioned over the acromion process of the scapula, thereby providing securement and comfort to the wearer.

10 Claims, 3 Drawing Sheets

(56) References Cited

U.S. PATENT DOCUMENTS

| | | | | |
|---|---|---|---|---|
| 5,914,166 | A | 6/1999 | Le | |
| 5,964,642 | A * | 10/1999 | Fildan | A41F 1/006 2/323 |
| 6,110,007 | A | 8/2000 | Rittmann | |
| 6,293,844 | B1 * | 9/2001 | Dalton | A41C 3/00 450/1 |
| 6,302,761 | B1 * | 10/2001 | Wrenn | A41C 3/0057 450/86 |
| 7,056,186 | B1 * | 6/2006 | Weyenberg | A41C 3/02 450/58 |
| 7,938,711 | B1 * | 5/2011 | Johnston | A41F 1/006 450/1 |
| 8,075,369 | B2 * | 12/2011 | Hendrickson | A41C 3/0028 450/86 |
| RE43,766 | E | 10/2012 | Ostaseski | |
| 2003/0186619 | A1 * | 10/2003 | Falla | A41F 15/007 450/86 |
| 2008/0113587 | A1 * | 5/2008 | Richardson | A41C 3/0021 450/58 |
| 2009/0126084 | A1 * | 5/2009 | Fenske | A41C 3/005 2/338 |
| 2009/0197508 | A1 * | 8/2009 | Getz | A41C 3/0021 450/7 |
| 2011/0212668 | A1 * | 9/2011 | Mitchell | A41C 3/0014 450/86 |
| 2012/0171930 | A1 * | 7/2012 | Kaufman | A41C 3/0035 450/58 |
| 2013/0035018 | A1 | 2/2013 | Broussard | |

* cited by examiner

BREAST SUPPORT GARMENT

CROSS REFERENCE TO RELATED APPLICATIONS

This application claims the benefit of U.S. Provisional Application No. 62/201,498 filed on Aug. 5, 2015. The above identified patent application is herein incorporated by reference in its entirety to provide continuity of disclosure.

FIELD OF THE INVENTION

The present invention relates to breast support devices. More specifically, the present invention provides a breast support garment having straps configured to be positioned over the acromion process the wearer for providing support and comfort.

BACKGROUND OF THE INVENTION

Typically, brassieres or bras have straps that support the majority of a wearer's breasts. However, bras can be uncomfortable to wear for extended periods of time. Conventional bra straps are often too tight and can cause pain to the skin. Some individuals develop poor posture over time due to continued use of bras having a lack of comfortable support straps. Additionally, traditional straps often fall off the shoulder, which can be an annoyance and leaves the wearer with reduced or no breast support.

Bra strap designs have been largely unchanged for a long time. Individuals must often contend with straps that dig into their shoulders to the point where it may result in numbness in their fingers as the straps each pressed on a nerve, straps that irritatingly drop off the shoulder, and straps that dig into the flesh, producing visible bra lines that show unaesthetically through outerwear. In view of the following disadvantages in prior art breast supports, there is a need in the art for an improved breast support garment that provides comfort and securement to the wearer due a more accurate placement of the straps.

Devices have been disclosed in the prior art that relate to breast supports and breast support accessories. These include devices that have been patented and published in patent application publications. These devices generally relate to breast supports and accessories for increasing stability and comfort, such as U.S. Published Patent Application Number 2013/0035018, U.S. Reissued Pat. No. RE43766, U.S. Pat. No. 5,914,166, U.S. Pat. No. 5,221,227, and U.S. Pat. No. 6,110,007.

These prior art devices have several known drawbacks. These devices fail to provide a strap system that eliminates the problem of discomfort and slippage of the straps from the shoulder area. Additionally, the prior art devices generally relate to support systems having various hooks and clasps for changing the location of the straps and do not provide a fixed strap location for providing comfort to the wearer.

In light of the devices disclosed in the prior art, it is submitted that the present invention substantially diverges in design elements from the prior art and consequently it is clear that there is a need in the art for an improvement to breast support devices. In this regard the present invention substantially fulfills these needs.

SUMMARY OF THE INVENTION

In view of the foregoing disadvantages inherent in the known types of breast support devices now present in the prior art, the present invention provides a breast support garment wherein the same can be utilized for providing comfort, stability, and convenience for the user when wearing the same. The breast support garment includes a first breast cup adjacent to a second breast cup. Further included is a connecting band having a first end connected to the first breast cup and a second end connected to the second breast cup. A first strap is connected to the first breast cup at one end and to the connecting band at a second end, and a second strap is connected to the second breast cup at one end and to the connecting band at a second end. The first and second straps extend from the first and second breast cups in a direction opposing one another and are each secured thereto at an obtuse angle with respect to the connecting band. When worn by an individual, the first and second straps are positioned over the acromion process of the scapula, thereby providing securement and comfort to the wearer.

One object of the present invention is to provide a breast support garment having all of the advantages of prior art breast support devices and none of the disadvantages.

Another object of the present invention is to provide a breast support garment having reinforced strips around a perimeter of the first and second breast cups.

A further object of the present invention is to provide a breast support garment composed of a mesh material for breathability and comfort.

Other objects, features and advantages of the present invention will become apparent from the following detailed description taken in conjunction with accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
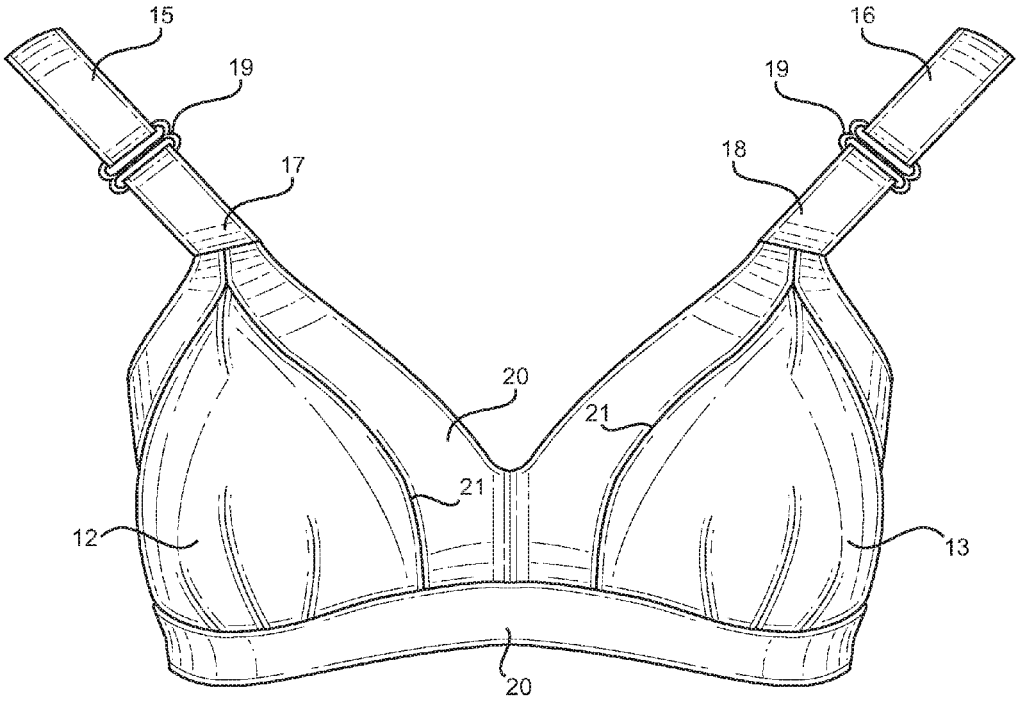
FIG. 1 shows a front perspective view of a breast support garment according to the present invention.

Reference is made herein to the attached drawings. Like reference numerals are used throughout the drawings to depict like or similar elements of the breast support garment. For the purposes of presenting a brief and clear description of the present invention, the preferred embodiment will be discussed as used for supporting the breasts of a wearer. The figures are intended for representative purposes only and should not be considered to be limiting in any respect.

Referring now to FIG. 1, there is shown a front perspective view of a breast support garment according to the present invention. The breast support garment generally comprises a first breast cup 12 adjacent to a second breast cup 13. Each of the first and second breast cups 12, 13 are dimensioned to support a breast of a wearer therein. In the illustrated embodiment, the first and second breast cups 12, 13 each have a perimeter 21. A plurality of reinforcement strips 20 are disposed around the perimeter 21 of the breast cups 12, 13. The reinforced strips may be composed of a reinforced fabric or other suitable material and provide additional support to the wearer.

A first strap 15 having a first end 17 is connected to an upper portion of the first breast cup 12 at the first end 17 thereof. Similarly, a second strap 16 having a first end 18 is connected to the second breast cup 13 at the first end 18 thereof. Each strap comprises a length adjustment mechanism thereon. In the illustrated embodiment, the adjustment mechanism is a slide adjuster 19 that can be slid along the length of the straps 15, 16 to adjust their length. Additionally, the first strap 15 and second strap 16 extend from the first breast cup 12 and second breast cup 13 in a direction opposing one another in order to ensure proper positioning of the straps when wearing the breast support garment. The first and second straps 15, 16 may further include reinforcement strips similar to those disposed around the perimeter of the breast cups 12, 13 in order to provide additional support.

Figure 2:
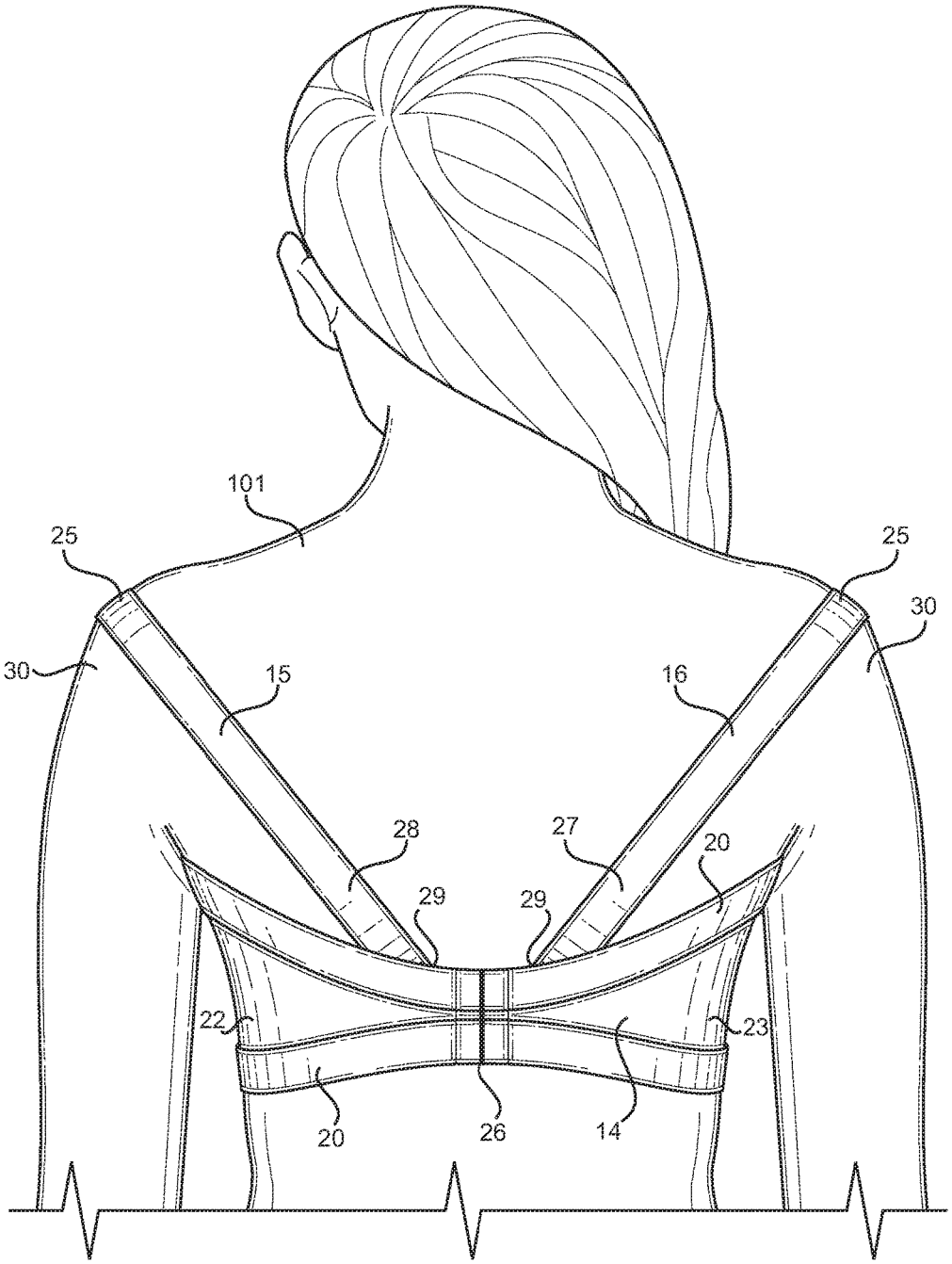
FIG. 2 shows a rear perspective view of a breast support garment according to the present invention being worn by an individual.

Referring now to FIG. 2, there is shown a rear perspective view of a breast support garment according to the present invention being worn by an individual. The breast support garment further comprises a connecting band 14 having a first end 22 connected to the first breast cup and a second end 23 connected to the second breast cup. The connecting band further includes a closure 26 thereon that connects the first end 22 of the connecting band 14 to the second end 23 of the connecting band 14. The closure 26 allows the band to be separated for easy removal of the breast support garment. In the illustrated embodiment, the connecting band 14 is surrounded by at least one of the plurality of support strips 20 in order to provide additional securement to the wearer. Further, the closure 26 is preferably disposed on the connecting band 14 such that it is equidistant from each of the first and second breast cups. The connecting band may also be composed of an elastic material to provide further comfort to the wearer.

When the breast support garment is worn, each of the first strap 15 and second strap 16 includes a contact point 25 wherein the straps contact the body 101 of the wearer. The contact point 25 is situated over the acromion 30, which is a bony process on the scapula that forms the summit of the shoulder. When supported over the acromion 30, the breast support garment rests comfortably on the wearer 101 and is better secured such that the straps 15, 16 will not slide in either direction. In this way, better securement is provided via the positioning of the straps 15, 16 over the acromion 30 of each shoulder.

The first strap 15 further includes a second end 28 that connects to the connecting band 14. Similarly, the second strap 16 includes a second end 27 that also connects to the connecting band 14. The first and second straps 15, 16 are each connected to the connecting band 14 and an angle 29. The angle 29 is an obtuse angle between ninety and one hundred eighty degrees with respect to the horizontal orientation of the connecting band 14. The angle 29 is one such that the straps 15, 16 rest over the acromion 30 when the breast support garment is worn.

Figure 3:
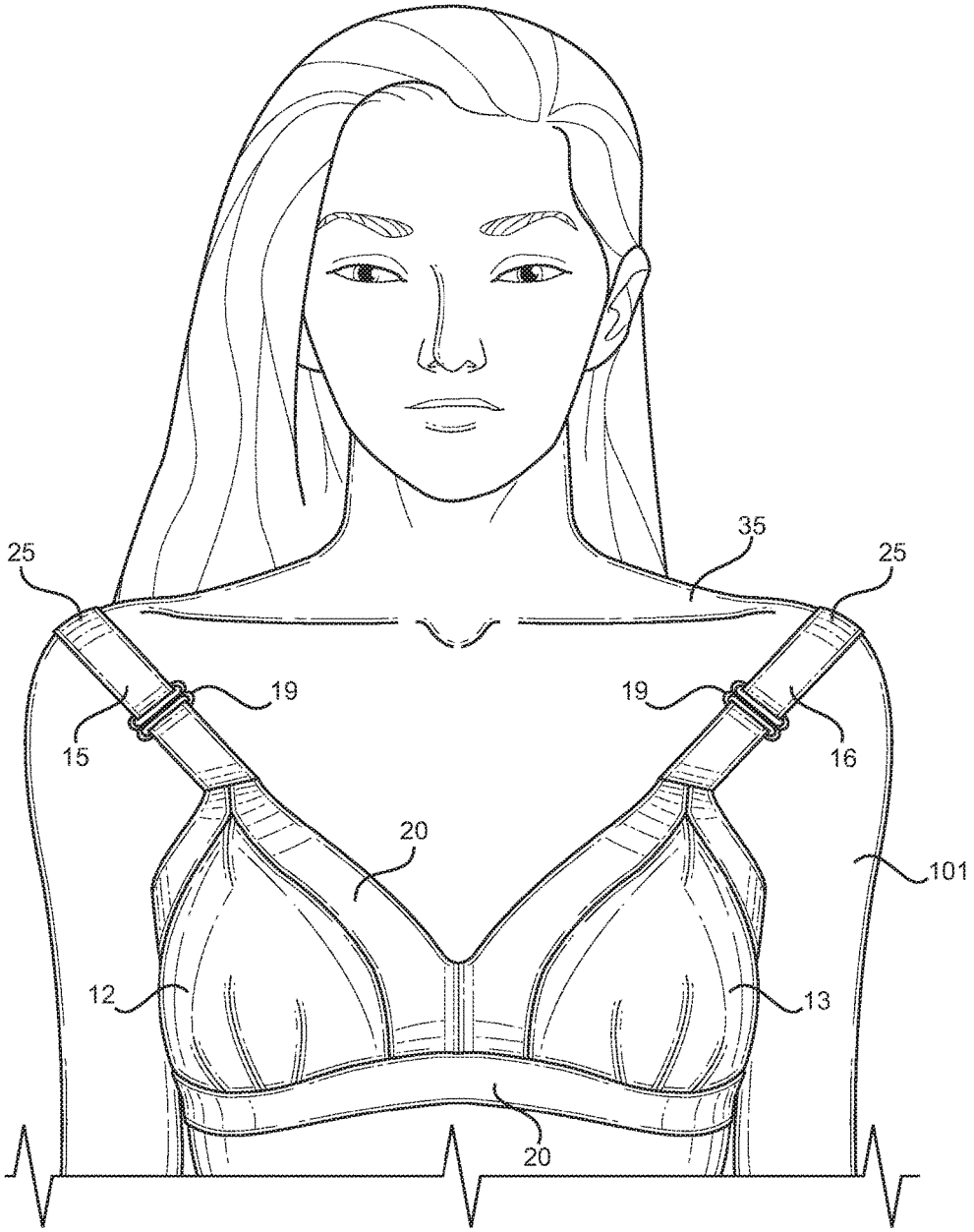
FIG. 3 shows a front perspective view of a breast support garment according to the present invention being worn by an individual.

Referring now to FIG. 3, there is shown a front perspective view of a breast support garment according to the present invention being worn by an individual. One or more portions of the breast support garment, such as the breast cups, straps, or connecting band may be composed of a mesh material to provide breathability and additional comfort. The first breast cup 12 and second breast cup 13 are shown supporting the breasts of a wearer 101 with the reinforcement strips 20 providing additional support. The length of the first strap 15 and second strap 16 is adjustable via the slide adjuster 19 so that the wearer can accurately attain a contact point 25 in a position above the acromion. The angle of the straps 15, 16 is such that the straps are adjacent to rather than over top of the clavicle 35 of the wearer 101. In this way, the straps 15, 16 support the breast cups 12, 13 without causing discomfort to the wearer and are more secured to the wearer.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A breast support garment, comprising:

a first breast cup and a second breast cup;

a connecting band having a first end and a second end, the first end of the connecting band secured to the first breast cup and the second end secured to the second breast cup, the connecting band maintaining a horizontal position;

a first strap having a first end and a second end, wherein the first end of the first strap is connected to the first breast cup and the second end of the first strap is connected to the connecting band;

a second strap having a first end and a second end, wherein the first end of the second strap is connected to the second breast cup and the second end of the second strap is connected to the connecting band;

wherein the first strap extends from the first breast cup at an obtuse angle with respect to the connecting band;

wherein the second strap extends from the second breast cup at an obtuse angle with respect to the connecting band such that the second strap extends from the second breast cup in a direction opposing the first strap; and wherein the first strap is configred to be positioned over a first acromion bone and the second strap is configred to be positioned over a second acromion bone when the breast support garment is worn by a user.

2. The breast support garment of claim 1, wherein the connecting band is composed of an elastic material.

3. The breast support garment of claim 1, wherein the angle between the first strap and the connecting band is between ninety degrees and one hundred eighty degrees.

4. The breast support garment of claim 1, wherein the angle between the second strap and the connecting band is between ninety degrees and one hundred eighty degrees.

5. The breast support garment of claim 1, further comprising a plurality of reinforcement strips, wherein the reinforcement strips are disposed around a perimeter of each of the first breast cup and the second breast cup.

6. The breast support garment of claim 1, wherein each of the first and second straps are adjustable in length via a length adjustment mechanism disposed thereon.

7. The breast support garment of claim 6, wherein the length adjustment mechanism is a slide adjuster.

8. The breast support garment of claim 1, wherein the breast support garment is composed of a mesh material.

9. The breast support garment of claim 1, wherein the connecting band comprises a closure thereon, wherein the closure releasably secures the first end of the connecting band to the second end of the connecting band.

10. The breast support garment of claim 9, wherein the connecting band closure is disposed on the connecting band such that it is equidistant from each of the first breast cup and second breast cup.

* * * * *